US007563056B2

(12) United States Patent
Gambill

(10) Patent No.: US 7,563,056 B2
(45) Date of Patent: Jul. 21, 2009

(54) TELESCOPING PILING APPARATUS AND METHOD

(75) Inventor: Robin Gambill, Pensacola, FL (US)

(73) Assignee: Port-of-Call USA, Inc., Pensacola, FL (US)

( * ) Notice: Subject to any disclaimer, the term of this patent is extended or adjusted under 35 U.S.C. 154(b) by 262 days.

(21) Appl. No.: 11/391,508

(22) Filed: Mar. 28, 2006

(65) Prior Publication Data

US 2007/0231079 A1 Oct. 4, 2007

(51) Int. Cl.
*E02D 5/22* (2006.01)

(52) U.S. Cl. ..... 405/196; 405/227

(58) Field of Classification Search ..... 405/196, 405/219, 227, 229
See application file for complete search history.

(56) References Cited

U.S. PATENT DOCUMENTS

| | | | | |
|---|---|---|---|---|
| 3,131,542 A | | 5/1964 | Koch | |
| 3,543,523 A | * | 12/1970 | Nelson | 405/227 |
| 3,817,040 A | | 6/1974 | Stevens | |
| 3,834,168 A | | 9/1974 | Holley, Jr. | |
| 3,965,687 A | * | 6/1976 | Shaw | 405/226 |
| 4,158,516 A | | 6/1979 | Noblanc et al. | |
| 4,923,336 A | | 5/1990 | Schmidt | |
| 5,347,949 A | | 9/1994 | Winston | |
| 5,584,606 A | | 12/1996 | Hoogasian, Jr. | |
| 5,704,732 A | | 1/1998 | Horton | |

FOREIGN PATENT DOCUMENTS

| | | | |
|---|---|---|---|
| DE | 3338135 | * | 5/1985 |
| JP | 02176017 A | * | 7/1990 |

OTHER PUBLICATIONS

International Search Report and Written Opinion for PCT/US07/07787 mailed on Nov. 26, 2008.

* cited by examiner

*Primary Examiner*—John Kreck
(74) *Attorney, Agent, or Firm*—Speed Law Firm

(57) ABSTRACT

Embodiments include a piling apparatus for providing support for one or more structures on, in, under, or into a body of water, a floor of the body of water, or a floor bed, comprising at least three concentric and generally coaxial bodies comprising an outer body having a first longitudinal bore therethrough, a middle body having a second longitudinal bore therethrough, the middle body operatively connected to the one or more structures, and an inner body having a third longitudinal bore therethrough, wherein the middle body is disposed between the inner and outer bodies, wherein the inner and outer bodies are operatively connected to one another and the middle body is moveable longitudinally and generally coaxially relative to the inner and outer bodies to stabilize the one or more structures. Embodiments include a method for supporting one or more structures using a piling apparatus. Embodiments include a method of installing piling at a location, comprising providing piling comprising one or more generally concentric tubes; forcing a pressurized fluid into at least one of the tubes; lowering the piling; forming a hole at the location using the pressurized fluid exiting from the piling; and installing the piling at the location.

6 Claims, 5 Drawing Sheets

TELESCOPING PILING APPARATUS AND METHOD

BACKGROUND OF THE INVENTION

1. Field of the Invention

Embodiments of the present invention generally relate to piling for docks, slips, piers, platforms, houses, commercial buildings, barges, or any other water structure residing in, under, into, and/or on a body of water; on, in, under, and/or into a floor (of floor bed) of a body of water; and/or on, in, under, and/or into land proximate to a body of water.

2. Description of the Related Art

Piling is used to provide support or protection for wharves, piers, docks, floats, etc. and is typically constructed of multiple piles. The piles are typically poles which are driven into the floor of a body of water to support a pier, float, dock, wharf, etc. Additionally, the piles act as anchors to which watercraft, such as a boat, may be tied.

The conventional pile involves a single pole constructed of wood, metal, or concrete. Installing each pile usually involves employing expensive underwater drilling equipment which is external to the piling. The drilling equipment must be rented or purchased and transported to the site for installation of the piles, and a drilling crew must be employed at the site to install the piles. After the drilling crew places the drilling equipment in the body of water, the drilling equipment is used to drill holes in the floor of the body of water at the locations in which the piles are to be placed. The drilling equipment is then removed, and the piling is inserted into the drilled-out locations in the floor of the body of water. Usually, concrete is poured around the piling at each location to secure the piles relative to the water with the intention of preventing the piles from moving with the ebb and flow of the body of water.

The typical method described above of installing the piling using external underwater drilling equipment and securing the piling by pouring concrete is undesirable for several reasons. First, specialized, expensive (to rent or purchase) equipment and labor are needed to drill the holes and to pour the concrete at the piles. Second, installing the piling using the current method requires at least two underwater trips to complete the installation, one or more trips to drill the hole with the underwater drilling equipment and one or more trips to insert and install the piling in the drilled-out hole, these multiple trips requiring much time, effort, and expense. Additionally, to install the piling at the exact location of the previously drilled-out hole in the floor of the body of water is challenging and adds extra time and expense to the dock installation. Third, the prior installation method, specifically the permanence of the concrete as well as the trouble and expense required to remove and/or reinstall the piling, limits the portability of the piling and the dock if one desires to move the dock to another location or to temporarily or permanently remove the dock and piling from the water. Again, the removal of the dock from the water (and re-installation at another location, if desired) requires expensive external equipment and labor. All in all, installation of a dock using the current installation method and current dock piling apparatus can easily run upwards of $50,000.

In addition to the method of their installation, the typically utilized piles are problematic because of their inability to give way enough to external forces without breaking. One of the more troublesome external forces affecting the dock and the piling is caused by storms, e.g., hurricanes and tropical storms which plague waterways, tornadoes, thunderstorms. These storms often bring strong or turbulent winds, disturbed or turbulent water, and/or rising water or wind levels which exert force on the dock and piling, often damaging, fracturing, and/or destroying the piling and/or the dock supported thereby. The typical one-piece piles are easily broken and damaged by storms and other weather conditions due to their inability to ebb and flow with the water and the wind. Damage and breakage of the dock piling or dock requires costly repair of the dock and/or piling or full replacement of the dock and/or piling, again possibly costing upwards of $50,000.

There is therefore a need for piling and a piling apparatus which are more easily, efficiently, and inexpensively installed in the body of water, on, in, under, or into a floor (or floor bed) of a body of water, and/or on, in, under, or into land near a body of water than the prior art piling.

There is a further need for piling and a piling apparatus which are more portable than the piling of the prior art.

There is yet a further need for piling and a piling apparatus which are more easily, efficiently, and inexpensively removed from the body of water, from the floor of the body of water, and/or from the land near the body of water than the prior art piling.

There is also a need for a method of installing piling and a piling apparatus which is more efficiently, inexpensively, and easily accomplished than current methods of installing piling.

There is a further need for a method of removing piling and a piling apparatus which is more efficiently, inexpensively, and easily accomplished than current methods of removing piling.

Additionally, there is a need for piling and a piling apparatus which are able to better withstand external forces applied thereto, for example forces such as wind, turbulent water, and/or rising water due to a storm.

SUMMARY OF THE INVENTION

It is therefore an object of embodiments of the present invention to provide a stable, efficiently-installable, and efficiently-removable piling apparatus which possesses the ability to withstand external forces, such as water or wind forces caused by a storm, as well as rising water or wind levels.

It is a further object of embodiments of the present invention to provide a piling apparatus which is more easily, efficiently, and inexpensively installable in a body of water, on, in, under, or into a floor (or floor bed) of a body of water, and/or on, in, under, or into land near a body of water than the prior art piling.

It is a further object of embodiments of the present invention to provide a piling apparatus which is more portable than the piling of the prior art.

It is a further object of embodiments of the present invention to provide a piling apparatus which is more easily, efficiently, and inexpensively removable from a body of water, from a floor (or floor bed) of the body of water, and/or from the land near the body of water than the prior art piling.

It is a further object of embodiments of the present invention to provide a method for installing a piling apparatus which is more efficiently, inexpensively, and easily accomplished than current methods of installing piling.

It is a further object of embodiments of the present invention to provide a method for removing and optionally reinstalling a piling apparatus which is more efficiently, inexpensively, and easily accomplished than current methods of removing and/or reinstalling piling.

It is a further object of embodiments of the present invention to provide a piling apparatus which is able to better withstand external forces applied thereto, for example forces such as wind, turbulent water, and/or rising water due to a storm or other conditions.

Toward the fulfillment of these and other objects and advantages, embodiments of the present invention comprise a piling apparatus for providing support for one or more structures on a body of water, or on or in a land location proximate to the body of water, comprising at least three generally concentric bodies generally coaxial with one another, the at least three bodies comprising an outer body having a first longitudinal bore therethrough, a middle body having a second longitudinal bore therethrough, the middle body operatively connected to the one or more structures, and an inner body having a third longitudinal bore therethrough, wherein the middle body is disposed between the inner and outer bodies, wherein the inner and outer bodies are operatively connected to one another, and wherein the middle body is moveable longitudinally and generally coaxially relative to the inner and outer bodies to stabilize the one or more structures.

Also toward the fulfillment of these and other objects and advantages, embodiments of the present invention comprise a method of installing a piling on a floor of a body of water, or on or in a land location proximate to the body of water, comprising providing the piling, the piling comprising one or more generally concentric tubes; forcing a pressurized fluid into at least one of the one or more tubes; lowering the piling through the body of water; forming a hole at a location in the floor of the body of water using the pressurized fluid exiting from the piling; and installing the piling at the location. Further embodiments of the present invention comprise a method of supporting one or more structures on a body of water, comprising providing a piling apparatus having a first tubular body, second tubular body, and an outermost third tubular body, the tubular bodies generally concentric to one another, the second tubular body capable of telescoping relative to the first and third tubular bodies, and the second tubular body operatively connected to the one or more structures; at least substantially immovably securing the first and third tubular bodies at a location in a floor of the body of water; and telescoping the second tubular body relative to the first and third tubular bodies when a water level of the body of water rises above the third tubular body.

BRIEF DESCRIPTION OF THE DRAWINGS

So that the manner in which the above-recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
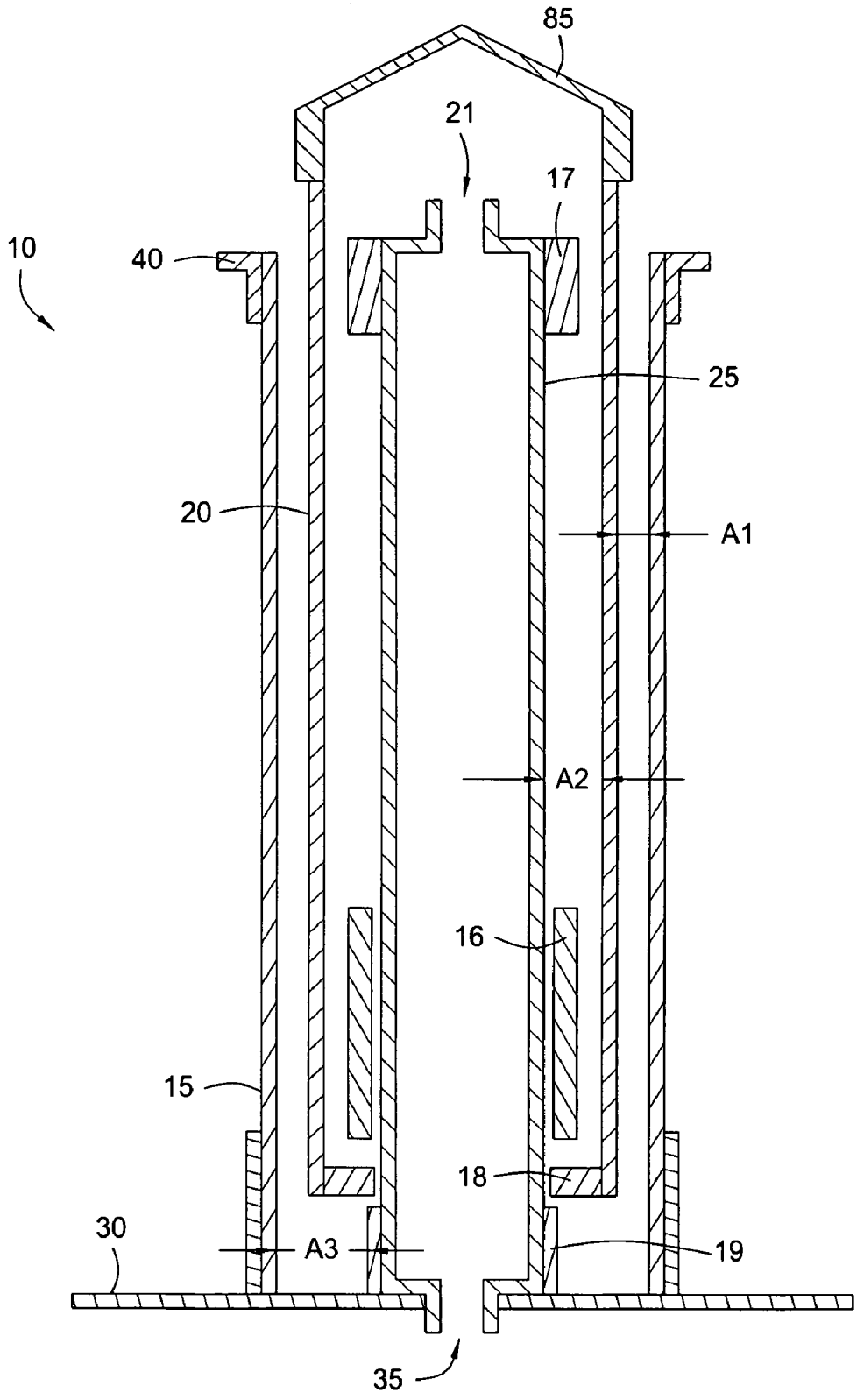
FIG. 1 is a section view of an embodiment of a piling apparatus.

Embodiments of the present invention advantageously provide a piling apparatus capable of drilling or forming its own hole for placement therein. In one embodiment, the piling apparatus includes one or more concentric tubes. In another embodiment, the concentric tubes are capable of telescoping relative to one another. In another embodiment, tubes may be substituted with other bodies with longitudinal bores running therethrough, the bodies having cross-sections of other shapes known to those skilled in the art, including but not limited to triangular, square, and rectangular shapes. All of the embodiments described below may include, instead of tubes or tubular bodies, other bodies with longitudinal bores running therethrough along their lengths, the bodies having cross-sections of other shapes known to those skilled in the art.

Embodiments of the present invention further advantageously provide a method of installing piling using the piling to drill its own hole for placement therein.

Embodiments of the present invention provide a piling apparatus which is capable of stable installation of the piling in, on, or into a body of water, on, in, under, or into a floor (or floor bed) of a body of water, and/or on, in, under, or into land near a body of water without drilling a hole in the floor, floor bed, or land near the body of water with external equipment. Furthermore, embodiments provide a piling apparatus which is capable of removal from a body of water, from a floor (or floor bed) of the body of water, and/or from the land near the body of water without the need for external equipment (other than supporting equipment for the piling apparatus such as one or more barges/platforms and/or cranes, wenches, and water pumps with hoses) and actions within the body of water or near the body of water.

Embodiments further advantageously provide a piling apparatus which is capable of stable installation of the piling in, on, or into a body of water, on, in, under, or into a floor (or floor bed) of a body of water, and/or on, in, under, or into land near a body of water without the use of drilling labor and drilling (or other hole-forming) equipment within or proximate to the body of water which is extraneous to the dock piling apparatus.

Embodiments also advantageously provide a method of installing a piling apparatus for supporting a dock or other support, where the piling apparatus itself is utilized to form a hole in the floor or floor bed of the body of water, or at the location near the body of water, for its subsequent installation.

Embodiments further beneficially provide a method of stabilizing and weighting down the piling apparatus by using the piling apparatus to deposit portions of the earth from the floor or floor bed of the body of water, or from the land location proximate to the body of water, at or near the installation site onto a portion of the piling apparatus.

Embodiments advantageously decrease the expense of the installation and/or removal operation by reducing the labor and equipment required to install piling. Reducing the labor and equipment required to install and/or remove piling also facilitates installation and/or removal of piling.

Embodiments further advantageously provide for portable, stable piling apparatus and installations.

Furthermore, embodiments provide more stable piling so that the support which is supported by the piling is capable of withstanding forces applied to the piling by a disturbed body of water, turbulent winds, rising water, or turbulent water, e.g., due to a storm or another weather condition. In one embodiment, the piling apparatus includes one or more tubes (or bodies of other shapes having longitudinal bores running therethrough) which are capable of telescoping relative to one another so that the piling apparatus gives but does not break upon a surge of pressure exerted by, for example, wind/water turbulence and/or rising levels.

FIGS. 1-4 illustrate a piling apparatus 10 of embodiments of the present invention. Referring to FIGS. 1-4, the piling apparatus includes one or more concentric tubular bodies (or other concentric bodies with longitudinal bores running therethrough having any cross-sectional shape known to those skilled in the art, e.g., triangular, square, oval, or rectangular cross-sectional shapes) which are coaxial with one another, where at least one of the concentric tubular bodies is capable of moving relative to the remaining tubular body or bodies. The tubular bodies may include, for example, piping or tubing. (Other bodies with longitudinal bores therethrough in lieu of tubular bodies may be utilized in embodiments described herein, including bodies of any cross-sectional shape known to those skilled in the art.) In the embodiment shown in FIGS. 1-4, the concentric tubular bodies include an outer tube 15, a primary inner tube 20 disposed within the outer tube 15, and an inner tube 25 disposed within the primary inner tube 20. The tubes 15, 20, 25 may instead be constructed from PVC or steel piping or tubing, although the tubes may be constructed from any material known by those skilled in the art for forming piling, piping, or tubing. Preferably, the material from which the piling or tubing is constructed is selected based upon the application and the load limitation capacity needed.

A foot piece 30 operatively connects the inner and outer tubes 25, 15. As described in more detail below and illustrated in FIG. 3, the foot piece 30 may ultimately rest on a floor 50 (or floor bed) of a body of water 55 and aid in anchoring the piling apparatus 10 at the desired location in the body of water 55. (Instead of the piling apparatus 10 being installed in the body of water at the floor 50 or floor bed, the piling apparatus 10 may be installed on, in, under, and/or into the floor 50 or floor bed or may be installed on, in, under, and/or into land at a location proximate to a body of water, for example where the land is a dry bed near the body of water in the case where rising water may potentially reach that formerly dry land location. In all of the described embodiments, the piling apparatus 10 may be installed in, on, under, and/or into the floor, floor bed, or land proximate to the body of water in lieu of the location mentioned in this description.) Although the foot piece 30 is shown connected to the inner and outer tubes 25, 15 at their lower ends, it is understood that the inner and outer tubes 25, 15 may be operatively connected at any location thereon. Similarly, the inner and outer tubes 25, 15, may be operatively connected to the foot piece 30 at any locations on the foot piece 30 rather than the locations shown.

Figure 2:
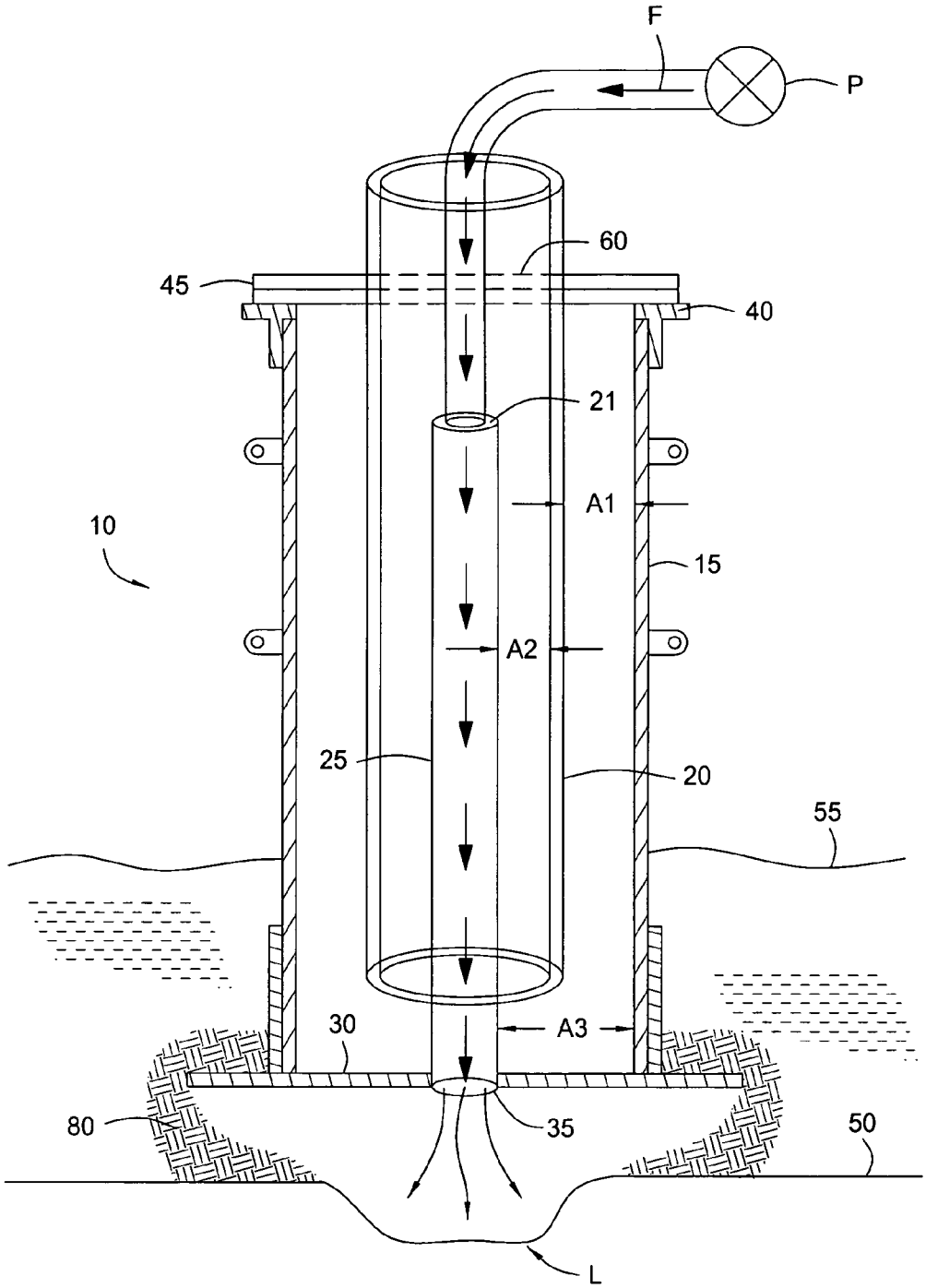
FIG. 2 is a perspective view of the piling apparatus of FIG. 1 in a body of water, where the piling apparatus itself is being used to install the piling apparatus in the body of water.
Figure 2A:
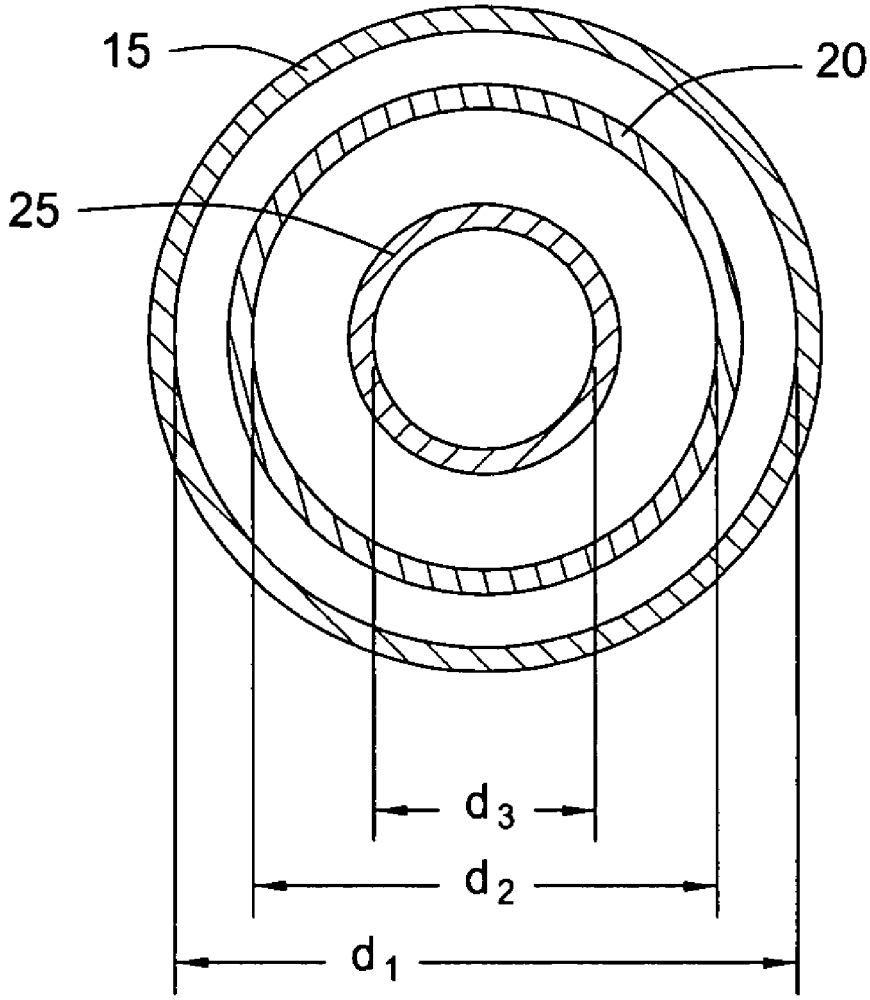
FIG. 2A is a cross-sectional view of the piling apparatus of FIG. 2.

As depicted in FIG. 2A, a bore of the outer tube 15 has a first inner diameter $d_1$, a bore of the primary inner tube 20 has a second inner diameter $d_2$, and a bore of the inner tube 25 has a third inner diameter $d_3$, where the first inner diameter $d_1$ is greater than the second inner diameter $d_2$, and where the second inner diameter $d_2$ is greater than the third inner diameter $d_3$. Although any dimensions of the tubes 15, 20, 25 are contemplated as within the scope of embodiments of the present invention, in one embodiment, an outer diameter of the outer tube 15 is approximately 6 inches, an outer diameter of the inner tube 25 is approximately 4 inches, and an outer diameter of the primary inner tube 20 is approximately 5 inches. Also in a one embodiment, the thickness of one or more of the tubes 15, 20, 25 is approximately ½-inch. Also in a one embodiment, a length of the outer tube 15 is approximately 16 feet. In another embodiment, the outer diameter of the inner tube 25 is approximately 5 inches, the outer diameter of the primary inner tube 20 is approximately 4 inches, and the outer diameter of the inner tube 25 is approximately 2 inches. The dimensions of the tubes 15, 20, 25 ultimately vary depending upon the load capacity needs of the application.

Between the inner diameter $d_1$ of the outer tube 15 and the outer diameter of the primary inner tube 20 is a first annular space A1 (see FIGS. 1-4), between the inner diameter $d_2$ of the primary inner tube 20 and the outer diameter of the inner tube 25 is a second annular space A2, and between the inner diameter $d_1$ of the outer tube 15 and the outer diameter of the inner tube 25 is a third annular space A3. In an embodiment (although not limiting to the scope of embodiments of the present invention), the first annular space A1 measures approximately ⅛-inch. The primary inner tube 20 is moveable upward and downward within the third annular space A3 within the confines of stops 17, 19 operatively attached to the inner tube 25, as described in more detail below.

The inner tube 25 and the outer tube 15 are operatively connected to one another. In the preferred embodiment, the inner and outer tubes 25, 15 are rigidly connected to one another via the foot piece 30 so that the inner and outer tubes 25, 15 remain at least substantially stationary relative to one another. In the shown preferred embodiment, the outer tube 15 is rigidly connected to an upper side of the foot piece 30, while the inner tube 25 is threadedly connected to a mid-portion of the upper side of the foot piece 30. In an alternate embodiment, the outer tube 15 and the foot piece 30 may be formed as one continuous piece, e.g., from a single mold, in another embodiment the inner tube 25 and the foot piece 30 may be formed as one continuous piece, e.g., from a single mold, and in yet a further embodiment, the inner tube 25, outer tube 15, and foot piece 30 may all be formed as one continuous piece, e.g., from a single mold.

Figure 3:
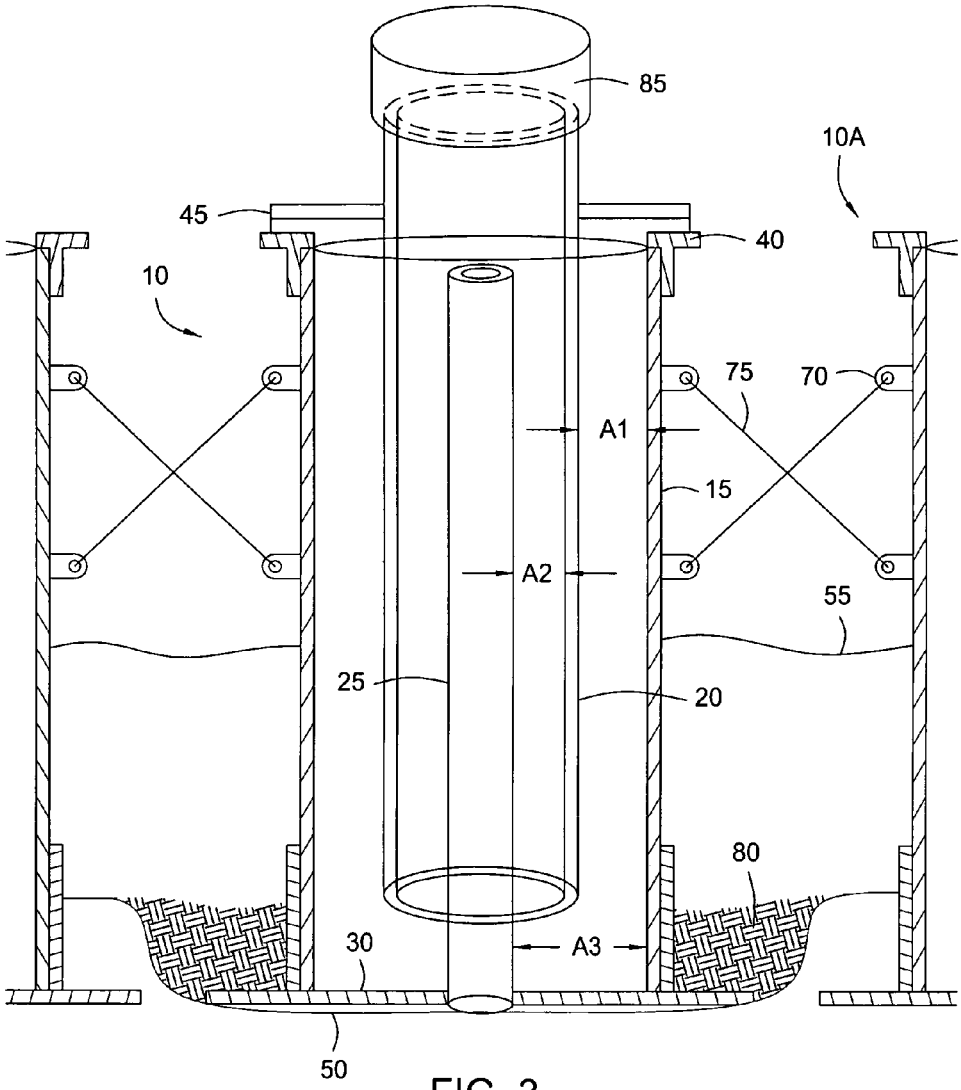
FIG. 3 is a perspective view of the piling apparatus of FIG. 1 installed in the floor of the body of water.

As shown in FIGS. 1-3, the inner tube 25 remains substantially unobstructed at its lower end; therefore, a corresponding hole 35 exists through the foot piece 30, preferably at or near a center of the foot piece 30, through which the inner tube 25 is inserted and the inner tube 25 is operatively connected to the foot piece 30, preferably by a threaded connection. The bore of the inner tube 25 is capable of being at least substantially unobstructed throughout its length to allow at least substantially unobstructed fluid flow through the inner tube 25 when desired (see description of operation of the piling apparatus 10 described below).

The concentric tubes 15, 20, 25 preferably remain at least substantially coaxial to one another during installation and operation of the piling apparatus 10, even when the primary inner tube 20 travels longitudinally within the third annular space A3 relative to the inner and outer tubes 25, 15. To maintain the tubes 15, 20, 25 in this coaxial positioning, one or more stops 16 or collars, such as stop tubes or other types of collars, for example aluminum collars, are preferably disposed within the annular space A2 to allow longitudinal movement of the primary inner tube 20 relative to the inner and outer tubes 15, 25 while at least substantially preventing axial movement of the primary inner tube 20 relative to the inner and outer tubes 15, 25. The stop 16 is capable of floating upward and downward longitudinally relative to the inner and outer tubes 25, 15, but is capable of only limited axial movement inward and outward relative to the central axes of the tubes 25, 15 due to the confines of defined annular space A2. Devices other than collars which are known to those skilled in the art may be utilized instead of the collars to perform the function of maintaining the tubes 15, 10, 25 in a substantially coaxial position relative to one another. In an alternate embodiment, the tubes 15, 20, 25 are not substantially coaxial to one another but are maintained in substantially the same relative axial position to one another.

Additional stops 17, 19, preferably stop blocks, are preferably operatively connected to the outer diameter of the inner tube 25, and a stop block 18 or shoulder is formed on the inner diameter of $d_2$ of the primary inner tube 20, preferably at its lower end. The stop block 18 or shoulder may either be formed as an extension to the primary inner tube 20 or be a separate piece operatively connected to the primary inner tube 20. Ultimately, the stop 18 and the stops 17, 19 limit longitudinal translation capability of the primary inner tube 20 and prevent its exit from the top of the piling apparatus 10.

Figure 4:
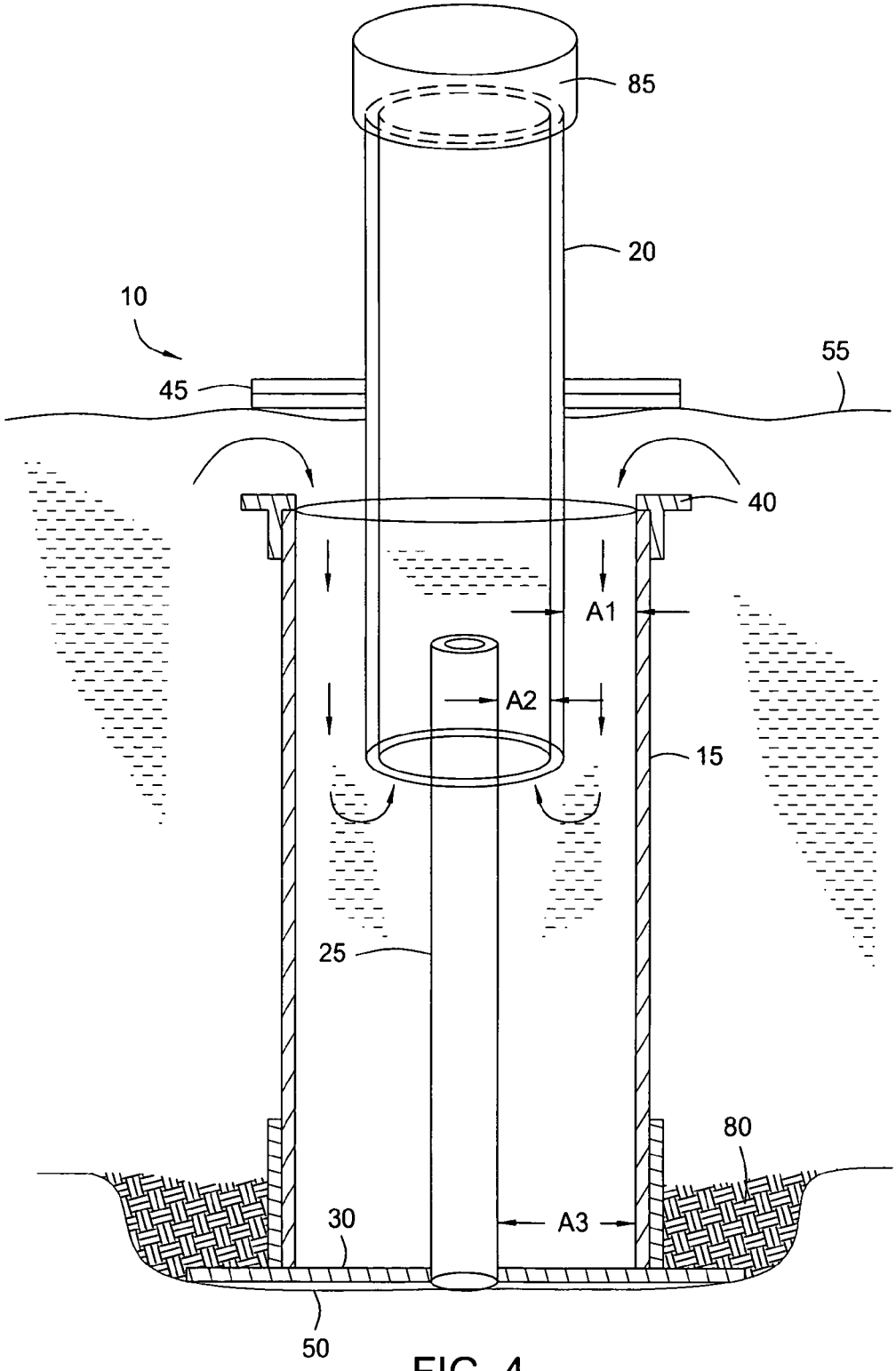
FIG. 4 is a perspective view of the piling apparatus, showing concentric tubing of the piling apparatus translated relative to one another along with the change in water level of the body of water.

A supporting apparatus 45 is supported by the piling apparatus 10, as shown in FIGS. 2-4. The supporting apparatus 45 may be, for example, a public or private dock for watercraft such as boats; marina, public, or private slips; piers; oil rig platforms; houses; commercial buildings, such as casinos; barges; and/or any structures which require flexibility with regard to the rise and fall of water, changes in wind and/or water currents, wind loads, or other external forces. Optionally, one or more bumpers 40 may be disposed at or near an upper end of the outer tubing 15 to lessen the impact on and potential damage to the upper end of the outer tubing 15 when a lower side face of the dock 45 contacts the piling apparatus 10, as described in more detail below.

A hole 60 is disposed through a portion of the supporting apparatus 45, and the primary inner tube 20 is disposed through this hole in the supporting apparatus 45. The supporting apparatus 45 and the primary inner tube 20 are operatively connected to one another, preferably rigidly connected to one another, through this hole 60 so that the primary inner tube 20 moves along with the supporting apparatus 45, and vice versa.

Optionally, as shown in FIG. 3, one or more spaced-apart hooks 70 may be disposed on an outer diameter of the piling apparatus 10, more specifically on the outer diameter of the outer tubing 15. The hooks 70 are capable of retaining one or more ties 75 for connecting one or more adjacent piling apparatus 10A to the piling apparatus 10, as shown in FIG. 3.

Referring first to FIG. 2, to install the piling apparatus 10 at a location L in (or on or into) the floor 50 of a body of water 55 (or at a location near the body of water), a pressurized fluid F is injected through the inner tubing 25 (for example a water-jet) and preferably flows downward through the inner tubing 25 and out its lower end 35, as shown. The piling apparatus 10 is lowered into the body of water 55 (or just lowered toward the land location in the case of installation in, on, or into a generally dry land location proximate to the body of water) while at least selectively forcing the fluid F through the inner tubing 25. To pressurize the fluid F flowing through the inner tubing 25, a fluid pump P or other fluid-pressurizing apparatus or method known to those skilled in the art may optionally be employed. As shown, the pump P is operatively connected to the upper end of the inner tube 25, for example by threadedly connecting tubing (e.g., hose) from the pump P to the upper end of the inner tube 25. In any event, pressurized fluid F is introduced into the upper end of the inner tube 25, flows through the length of the longitudinal bore of the inner tube, and exits the lower end of the inner tube 25 into the body of water 55 (or into the land location).

The fluid pressure out of the lower end of the piling apparatus 10 via the inner tube 25 provides a vortex swirling around the bottom of the piling apparatus 10 which performs multiple functions. First, the fluid F prevents debris, such as sediment and other materials, from the body of water 55 from entering the interior of the piling apparatus 10. Second, the fluid F allows the piling apparatus 10 to form its own hole at location L in the body of water 55 (or at the location near the body of water) for installation therein, thereby eliminating the need for an external drilling apparatus to form the hole.

The fluid F exiting the inner tube 25 drills into, on, in, under, or at the earth floor 50 (or floor bed) at location L (or into, on, in, under, or at a land location proximate to the body of water 50) by disturbing and thereby removing pieces 80 of the earth from the floor (or floor bed or the land location proximate to the body of water 50). At the same time, at least a portion of the disturbed earth pieces 80 migrate upward and outward relative to the piling apparatus 10 through the body of water 55 so that at least a portion of the earth pieces 80 migrate onto the top of the foot piece 30, as shown in FIG. 2. While this fluid drilling is occurring, the piling apparatus 10 is preferably in its resting position where the supporting apparatus 45 is resting on the bumper 40 (although all positions of the piling apparatus 10 are within the scope of embodiments of the present invention).

The pressurized fluid F is selectively introduced into the inner tube 25 until the installed position is reached, specifically until a sufficiently-sized hole is formed at the location L to house foot piece 30 and sufficient earth pieces 80 have migrated onto the foot piece 30 to anchor the pilling apparatus 10 at location L. These earth pieces 80 serve as anchors for the piling apparatus 10 at the location L and in the hole to retain the piling apparatus 10 in position in the body of water 55 (even when external forces act upon the piling apparatus 10). Therefore, the piling apparatus 10 is capable of self-filling the hole at the same time that it is self-forming the hole. Thus, in addition to eliminating the need for external tools and equipment for drilling the hole, the piling apparatus 10 of embodiments of the present invention eliminates the need for cement or another comparable setting substance to surround the piling apparatus 10 to maintain in position and anchor the piling (and also eliminates the need for the external equipment for pouring and setting the cement as well as an additional underwater trip for the cementing equipment). The installed position of the piling apparatus 10 is shown in FIG. 3.

Upon reaching the installed position, a cap 85 may optionally be placed on or near the upper end of the primary inner tube 20. This cap 85 performs the function of preventing debris from entering the piling apparatus 10. Additionally, the cap 85 creates a vacuum that pulls water into the piling apparatus 10 at a slowly rising pace when the water level of the body of water 55 rises as well as allows water flow out of the piling apparatus 10 at a slowly falling pace as the water level falls, as described below.

Optionally, before placing the cap 85 on the primary inner tube 20, cement or some other setting substance may be introduced into the bore of the inner tube 25 to further set and stabilize the piling apparatus 10 at the location L in (or into or on) the floor 50 (or the land location). While the cement advantageously stabilizes the piling apparatus 10 and helps prevent debris from flowing up through the bore of the inner tube 25 via its open lower end, the cement also decreases the portability of the piling apparatus 10. Therefore, if portability of the piling apparatus 10 is desired, it may be advisable to avoid cementing the bore of the inner tube 25.

Once the piling apparatus 10 is installed in (or on or into) the floor 50 (or the land location), the primary resting location of the supporting apparatus 45 on the bumper(s) 40 provides a rigid walkway or platform via the upward-facing side of the supporting apparatus 45, as shown in FIG. 3. This primary location is maintained unless sufficient wind and/or water level and/or force cause the supporting apparatus 45 and primary inner tube 20 to move upward relative to the remainder of the piling apparatus 10.

When water levels or wind levels rise, FIG. 4 shows the telescoping action of the piling apparatus 10. Rising water or wind levels, and/or turbulence of the water and/or wind cause the supporting apparatus 45 and its connected primary inner tube 20 to telescope upward relative to the remainder of the piling apparatus 10 and the floor 50. This telescoping of the piling apparatus 10 helps prevent the supporting apparatus 45 and/or piling apparatus 10 from damage and/or breakage due to turbulent water and/or wind conditions or rising water and/or wind levels (for example due to a storm) exerting pressure on the dock 45 and/or piling apparatus 10, so that the piling apparatus 10 gives without breaking.

As the primary inner tube 20 telescopes relative to the outer and inner tubes 15, 25, water from the rising body of water 55 is allowed to enter into the piling apparatus 10 by flowing between the supporting apparatus 45 and the bumper(s) 40 and into the bore of the outer tube 15 and the remainder of the piling apparatus 10. If the primary inner tube 20 is closed at or near its upper end, such as by the cap 85, the flow of the body of water 55 into the piling apparatus 10 and the rising telescoping of the primary inner tube 20 is gradual, thereby avoiding breakage and/or damage to the piling apparatus 10 and supporting apparatus 45 caused by abrupt motion.

When the water level of the body of water 55 falls, the primary inner tube 20 telescopes downward relative to the remainder of the piling apparatus 10. Again, if the primary inner tube 20 is closed at or near its upper end, the falling telescoping action of the primary inner tube 20 is gradual, thereby avoiding breakage and/or damage to the piling apparatus 10 and supporting apparatus 45 due to abrupt motion. When the water level falls below an upper end of the piling apparatus 10, the supporting apparatus 45 again is at its primary location resting on the bumper(s) 40 of the piling apparatus 10.

As is evident from the above description, the outer tube 15 and inner tube 25 preferably remain at least substantially stationary relative to the floor 50 of the body of water 55 (or relative to the floor bed or land location). As is also evident, the primary inner tube 20 and the supporting apparatus 45 are capable of telescoping relative to the remainder of the piling apparatus 10 (and relative to the floor 50) when sufficient force is applied to the piling apparatus 10 and/or the supporting apparatus 45 to cause the primary inner tube 20 to give way rather than to break or damage the piling apparatus 10.

As described above, the piling apparatus 10 is capable of installation without any external drilling apparatus, other drilling tools, or other external apparatus (other than a barge or platform from which to lower the piling apparatus, and a crane, a wench, and a water pump with a hose, or other similar devices for performing similar functions). Furthermore, the piling apparatus 10 is also capable of removal from the location L (and optional subsequent installation at another location) without the use of any external removal apparatus or other tools other than a barge or platform from which to work and a crane, wench, and water pump with a hose or other similar devices for performing these functions. The combination of pumping pressurized fluid F down through the inner tube 25 and the upward pulling of the piling apparatus 10 dislodges the piling apparatus 10 from the location L at the floor 50.

The piling apparatus 10 described above increases the resilience of the supported structure as well as the piling apparatus 10 itself to surges, turbulent winds and water, rising water levels, tides, and/or currents. It is understood for embodiments of the present invention that the piling apparatus may be installed or located at any land location susceptible to rising water levels and/or turbulent wind or water, even if that location is not within a body of water or near the body of water. Furthermore, the piling apparatus may be installed or located at any land location as a protective measure against rising water levels and/or turbulent water and/or winds. While the foregoing is directed to embodiments of the present invention, other and further embodiments of the invention may be devised without departing from the basic scope thereof, and the scope thereof is determined by the claims that follow.

The invention claimed is:

1. A piling apparatus for providing support for one or more structures on or near a body of water, comprising:

at least three concentric bodies generally coaxial with one another, the at least three bodies comprising:

an outer body having a first longitudinal bore therethrough, a middle body, the middle body having a second longitudinal bore therethrough and operatively connected to the one or more structures, and an inner body having a third longitudinal bore therethrough, wherein the middle body is disposed between the inner and outer bodies, wherein the inner and outer bodies are operatively connected to one another, and wherein the middle body is moveable longitudinally and generally coaxially relative to the inner and outer bodies to stabilize the one or more structures, wherein:

the at least three concentric bodies are at least three concentric tubular bodies, the outer body is an outer tubular body, the middle body is a middle tubular body, the inner body is an inner tubular body, and the inner and outer tubular bodies are operatively connected to one another via a foot member capable of resting on a floor of the body of water.

2. A piling apparatus for providing support for one or more structures on or near a body of water, comprising:

at least three concentric bodies generally coaxial with one another, the at least three bodies comprising:

an outer body having a first longitudinal bore therethrough, a middle body, the middle body having a second longitudinal bore therethrough and operatively connected to the one or more structures, and an inner body having a third longitudinal bore therethrough, wherein the middle body is disposed between the inner and outer bodies, wherein the inner and outer bodies are operatively connected to one another, and wherein the middle body is moveable longitudinally and generally coaxially relative to the inner and outer bodies to stabilize the one or more structures, wherein:

the at least three concentric bodies are at least three concentric tubular bodies, the outer body is an outer tubular body, the middle body is a middle tubular body, and the inner body is an inner tubular body, further comprising cap disposed on an upper end of the inner tubular body to create a vacuum therein, wherein the one or more structures comprises a dock.

3. A method of supporting one or more structures on or near a body of water, comprising:

providing a piling apparatus having a first tubular body, second tubular body, and an outermost third tubular body, the tubular bodies generally concentric to one another, the second tubular body capable of telescoping relative to the first and third tubular bodies, and the second tubular body operatively connected to the one or more structures;

at least substantially immovably securing the first and third tubular bodies at a location in a floor of the body of water or at a land location near the body of water; and telescoping the second tubular body relative to the first and third tubular bodies when a water level of the body of water rises above the third tubular body.

4. The method of claim 3, wherein the first tubular body is an innermost tubular body and the second tubular body is disposed concentrically between the first and third tubular bodies.

5. The method of claim 4, wherein at least a portion of the body of water flows into the piling when the water level rises above the third tubular body, the method further comprising creating a vacuum within the second tubular body to allow for measured telescoping of the second tubular body when the water level rises above the third tubular body.

6. The method of claim 3, wherein the telescoping of the second tubular body is caused by the body of water pushing against an underside of the one or more structures when the water level rises above the third tubular body, the one or more structures comprising a dock.

* * * * *